US011796946B2

(12) United States Patent
Inagaki et al.

(10) Patent No.: US 11,796,946 B2
(45) **Date of Patent: *Oct. 24, 2023**

(54) BELT HAVING AN AGGREGATE WITH ENTAGLED AND NON-ENTANGLED FIBROUS CARBONS

(71) Applicant: FUJIFILM Business Innovation Corp., Tokyo (JP)

(72) Inventors: Tomotake Inagaki, Kanagawa (JP); Ryohei Yoshikawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/492,672

(22) Filed: Oct. 3, 2021

(65) Prior Publication Data

US 2022/0397850 A1 Dec. 15, 2022

(30) Foreign Application Priority Data

Jun. 3, 2021 (JP) ..... 2021-093752

(51) Int. Cl.
*G03G 15/20* (2006.01)
*G03G 15/16* (2006.01)

(52) U.S. Cl.
CPC ..... *G03G 15/2057* (2013.01); *G03G 15/161* (2013.01); *G03G 15/2064* (2013.01); *G03G 2215/2038* (2013.01)

(58) Field of Classification Search
CPC ..... G03G 15/161; G03G 15/2057; G03G 15/2064; G03G 2215/2038
See application file for complete search history.

(56) References Cited

U.S. PATENT DOCUMENTS

| | | | | |
|---|---|---|---|---|
| 9,250,585 | B2 | 2/2016 | Nakajima et al. | |
| 2014/0255067 | A1 * | 9/2014 | Matsunaka ..... | G03G 15/2057 399/333 |

FOREIGN PATENT DOCUMENTS

| | | |
|---|---|---|
| JP | 4680979 | 5/2011 |
| JP | 2019140105 | 8/2019 |

* cited by examiner

*Primary Examiner* — Joseph S Wong
(74) *Attorney, Agent, or Firm* — JCIPRNET

(57) ABSTRACT

A belt includes a resin and an aggregate in which plural fibrous carbons are entangled with each other, in which a maximum diameter of the aggregate is 50% or less of a belt film thickness.

20 Claims, 4 Drawing Sheets

BELT HAVING AN AGGREGATE WITH ENTAGLED AND NON-ENTANGLED FIBROUS CARBONS

CROSS-REFERENCE TO RELATED APPLICATIONS

This application is based on and claims priority under 35 USC 119 from Japanese Patent Application No. 2021-093752 filed Jun. 3, 2021.

BACKGROUND

(i) Technical Field

The present invention relates to a belt, a fixing belt, a fixing device, and an image forming apparatus.

(ii) Related Art

A belt containing a thermal conductive material and having high thermal conductivity is used in various fields.

For example, in an image forming apparatus using an electrophotographic method (such as a copier, a facsimile, and a printer), a fixing belt that fixes a toner image formed on a recording medium to the recording medium is mentioned.

JP4680979B discloses a polyimide tube in which carbon nanotubes are dispersed in a polyimide resin, as a needle-like high thermal conductive filler.

Further, JP2019-140105A discloses a functional film consisting of an aggregate consisting of entangled carbon nanotubes and having a diameter of 50 μm or less, a height of less than 5 μm, and a ratio (height/diameter) of the height to the diameter of less than 0.1.

SUMMARY

Aspects of non-limiting embodiments of the present disclosure relate to a belt having a high thermal conductivity and an excellent bending durability as compared with a case where a belt contains a resin and, as a thermal conductive material, only fibrous carbons that are not entangled with each other or a case where a belt contains a resin and an aggregate in which a plurality of fibrous carbons are entangled with each other, and where a maximum diameter of the aggregate is more than 50% of a belt film thickness.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

As specific means, the following aspects are contained.

According to an aspect of the present disclosure, there is provided a belt including a resin and an aggregate in which a plurality of fibrous carbons are entangled with each other, in which a maximum diameter of the aggregate is 50% or less of a belt film thickness.

BRIEF DESCRIPTION OF THE DRAWINGS

Exemplary embodiment(s) of the present invention will be described in detail based on the following figures, wherein.

DETAILED DESCRIPTION

Figure 1:
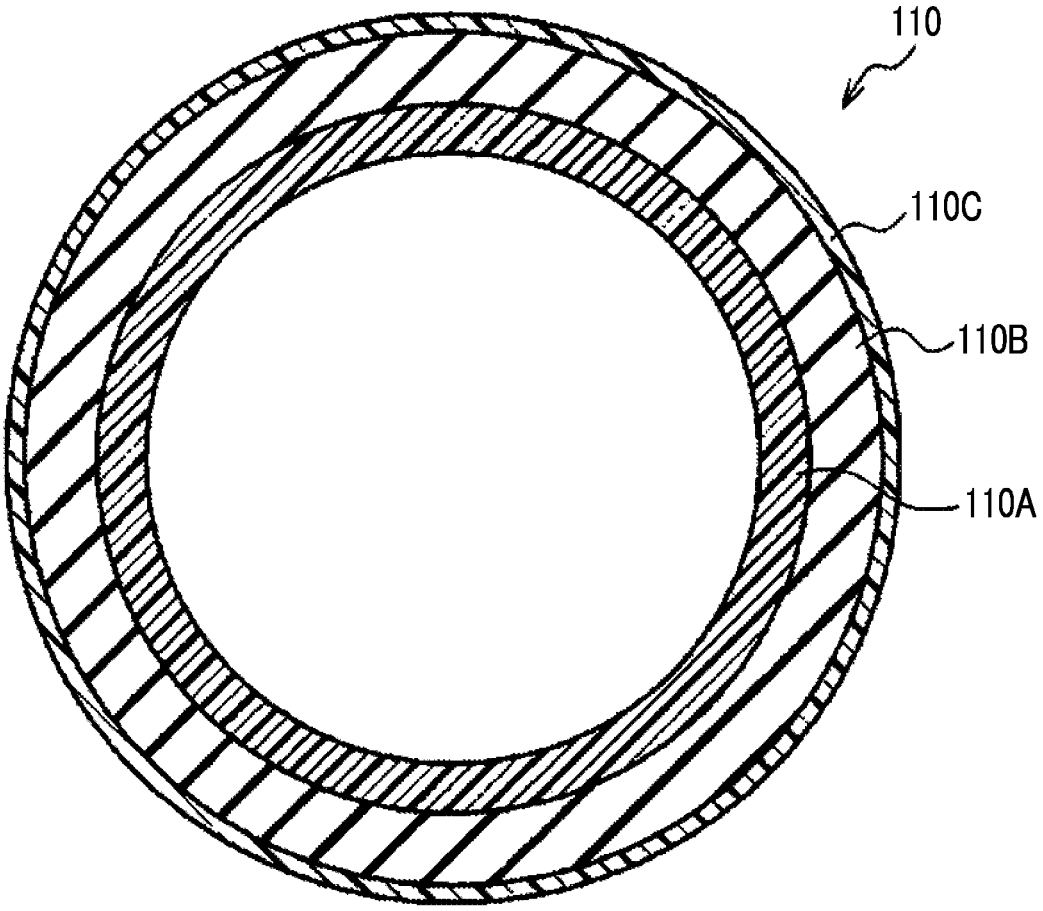
FIG. 1 is a schematic cross sectional diagram showing an example of a fixing belt according to the present disclosure.

Hereinafter, exemplary embodiments of the present disclosure will be described. These descriptions and examples illustrate the exemplary embodiments and do not limit the scope of the exemplary embodiments.

In a numerical range described stepwise in the present specification, an upper limit value or a lower limit value described in one numerical range may be replaced with an upper limit value or a lower limit value of another numerical range described stepwise.

Further, in a numerical range described in the present specification, an upper limit value or a lower limit value of the numerical range may be replaced with a value shown in examples.

In the present specification, each component may contain plural kinds of substances corresponding thereto.

In a case where the amount of each component in a composition is mentioned in the present specification and plural kinds of substances corresponding to each component are present in the composition, unless otherwise specified, the amount means a total amount of the plural kinds of substances present in the composition.

In the present specification, unless otherwise specified, a case where simply the term "belt according to the present disclosure" is used refers to a belt described in both a first exemplary embodiment and a second exemplary embodiment, which will be described later.

First Exemplary Embodiment of Belt

The first exemplary embodiment of the belt according to the present disclosure is a belt including a resin and an aggregate in which plural fibrous carbons are entangled with each other, in which a maximum diameter of the aggregate is 50% or less of a belt film thickness.

Hereinafter, the aggregate in which plural fibrous carbons are entangled with each other is appropriately referred to as a specific aggregate.

The first exemplary embodiment of the belt according to the present disclosure has a high thermal conductivity and an excellent bending durability due to the above configuration. The reason is presumed as follows.

The first exemplary embodiment of the belt according to the present disclosure includes the resin and the aggregate (that is, the specific aggregate) in which plural fibrous carbons are entangled with each other. It is presumed that since the specific aggregate transfers heat radially from a portion where the fibrous carbons are entangled (that is, a portion where the fibrous carbons are in contact with each other), the high thermal conductivity of the belt is obtained as compared with a case where the specific aggregate contains fibrous carbons that are not entangled with each other. Also, it is presumed that since, in the aggregate, plural fibrous carbons are entangled with each other and the resin enters gaps between the entangled fibrous carbons, both mutual adhesion between the fibrous carbons and mutual adhesion between the resin and the fibrous carbons in the aggregate increase, and the bending durability of the belt is excellent.

Hereinafter, the specific aggregate and the resin used in the first exemplary embodiment of the belt according to the present disclosure will be described.

Specific Aggregate

The first exemplary embodiment of the belt according to the present disclosure includes the aggregate (specific aggregate) in which plural fibrous carbons are entangled with each other. The specific aggregate is used as a thermal conductive material.

In the first exemplary embodiment of the belt according to the present disclosure, the maximum diameter of the specific aggregate is 50% or less of the belt film thickness. From the viewpoints of increasing the thermal conductivity of the belt and increasing the bending durability of the belt, the maximum diameter of the specific aggregate is, for example, preferably 40% or less, and more preferably 25% or less of the belt film thickness. On the other hand, the maximum diameter of the specific aggregate is, for example, more preferably 1% or more of the belt film thickness.

Further, from the viewpoints of increasing the thermal conductivity of the belt and increasing the bending durability of the belt, the maximum diameter of the specific aggregate is, for example, preferably 0.5 μm or more and 40 μm or less, more preferably 1 μm or more and 30 μm or less, and still more preferably, 3 μm or more and 20 μm or less.

The specific aggregate may be an aggregate in which plural fibrous carbons are entangled with each other and which has a maximum diameter of 50% by mass or less with respect to the belt film thickness, and a shape thereof is not particularly limited. The specific aggregate in the belt may be, for example, spherical, elliptical spherical, or irregularly shaped.

In the first exemplary embodiment of the belt according to the present disclosure, from the viewpoints of increasing the thermal conductivity of the belt and increasing the bending durability of the belt, the specific aggregate has a ratio (minor axis Y/major axis X) of a minor axis Y to a major axis X of, for example, preferably 1/10 or more and 1/1 or less, more preferably 1/10 or more and 4/5 or less, still more preferably 1/10 or more and 3/5 or less, and particularly preferably 1/10 or more and 1/3 or less.

The maximum diameter, the major axis X, and the minor axis Y of the specific aggregate are measured by the following method.

The belt is cut in a thickness direction with a microtome, and a belt cross section obtained is observed with an electron microscope. The major axis X, which is the longest axis of the specific aggregate, and the minor axis Y, which is the longest axis in a direction orthogonal to the major axis X are measured. The number of measurement samples of the specific aggregate is 10, a maximum value of the major axis X in 10 samples is the "maximum diameter of the specific aggregate", and the "major axis X" and the "minor axis Y" each are an arithmetic mean value of 10 samples.

The fibrous carbon contained in the specific aggregate has a length of, for example, preferably 1 μm or more and 100 μm or less, more preferably 2 μm or more and 80 μm or less, and still more preferably 3 μm or more and 60 μm or less.

The fibrous carbon contained in the specific aggregate has a diameter of, for example, preferably 20 nm or more and 300 nm or less, more preferably 25 nm or more and 250 nm or less, and still more preferably 30 nm or more and 200 nm or less.

The length and the diameter of the fibrous carbon configuring the specific aggregate are measured by the following method.

The belt is cut in the thickness direction with a microtome, a belt cross section obtained is observed with an electron microscope, and the length and the diameter of the fibrous carbons configuring the specific aggregate are measured. The number of measurement samples of the specific aggregate is 10, and two fibrous carbons are measured for each specific aggregate. The "length of the fibrous carbons configuring the specific aggregate" and the "diameter of the fibrous carbons configuring the specific aggregate" each are an arithmetic mean value of measured values for 20 points (10 samples×2 fibrous carbons).

The number of the fibrous carbons contained in the specific aggregate may be plural (that is, two or more fibrous carbons), and is not particularly limited.

The fibrous carbons contained in the specific aggregate are, for example, preferably carbon nanotubes from the viewpoints of availability, thermal conductivity, and the like.

In the first exemplary embodiment of the belt according to the present disclosure, a content of the specific aggregate is, for example, preferably 1% by mass or more and 20% by mass or less, more preferably 2% by mass or more and 18% by mass or less, still more preferably 2% by mass or more and 15% by mass or less, and particularly preferably 3% by mass or more and 15% by mass or less, with respect to a total mass of the belt.

The thermal conductivity of the belt is increased by increasing the content of the specific aggregate. On the other hand, in a case where the content of the specific aggregate is 20% by mass or less with respect to the total mass of the belt, the bending durability is increased.

Fibrous Carbons that are not Entangled with Each Other

From the viewpoint of further increasing the thermal conductivity of the belt, for example, it is preferable that the first exemplary embodiment of the belt according to the present disclosure contains fibrous carbons that are not entangled with each other in addition to the specific aggregate.

That is, the first exemplary embodiment of the belt according to the present disclosure, for example, preferably contains the resin, the specific aggregate, and the fibrous carbons that are not entangled with each other.

The "fibrous carbons that are not entangled with each other" refer to fibrous carbons which are free without belonging to the aggregate in which fibrous carbons are entangled with each other (that is, the specific aggregate) or fibrous carbons which do not have plural contact points with one aggregate in which fibrous carbons are entangled with each other, in belt cross section observation with an electron microscope.

The fibrous carbons that are not entangled with each other each have a length of, for example, preferably 1 μm or more and 1,000 μm or less, more preferably 2 μm or more and 500 μm or less, and still more preferably 3 μm or more and 300 μm or less.

The fibrous carbons that are not entangled with each other each have a diameter of, for example, preferably 20 nm or more and 300 nm or less, more preferably 25 nm or more and 250 nm or less, and still more preferably 30 nm or more and 200 nm or less.

The length and the diameter of the fibrous carbons that are not entangled with each other are measured by the following method.

The belt is cut in the thickness direction with a microtome, a belt cross section obtained is observed with an electron microscope, and the length and the diameter of the fibrous carbons that are not entangled with each other are measured. The number of measurement samples is 5, and the "length of the fibrous carbons that are not entangled with each other" and the "diameter of the fibrous carbons that are not entangled with each other" each are an arithmetic mean value of 5 samples.

The fibrous carbons that are not entangled with each other may be the same as or different from fibrous carbons contained in the specific aggregate (that is, the fibrous carbons configuring the specific aggregate).

The fibrous carbons that are not entangled with each other are, for example, preferably carbon nanotubes from the viewpoints of availability, thermal conductivity, and the like.

In a case where the first exemplary embodiment of the belt according to the present disclosure contains the fibrous carbons that are not entangled with each other, a content thereof is, for example, preferably more than 0% by mass and not more than 10% by mass, more preferably more than 0% by mass and not more than 8% by mass, still more preferably 0.5% by mass or more and 5% by mass or less, and particularly preferably 1% by mass or more and 5% by mass or less, with respect to a total mass of the belt.

From the viewpoints of increasing the thermal conductivity of the belt and increasing the bending durability of the belt, in the first exemplary embodiment of the belt according to the present disclosure, for example, it is preferable that a content A of the specific aggregate and a content B of the fibrous carbons that are not entangled with each other satisfy a relationship of A≥B on a mass basis.

From the viewpoints of increasing the thermal conductivity of the belt and increasing the bending durability of the belt, in the first exemplary embodiment of the belt according to the present disclosure, for example, it is preferable that a ratio (A/(A+B)) of the content A of the specific aggregate to a total amount of the content A of the aggregate and the content B of the fibrous carbons that are not entangled with each other is 0.50 or more and 0.95 or less on a mass basis.

The content A of the specific aggregate and the content B of the fibrous carbons that are not entangled with each other are measured by the following method.

The belt is cut in the thickness direction with a microtome, and a scanning electron microscope (SEM) image of a belt cross section obtained is image-analyzed. A total area of the specific aggregate and a total area of the fibrous carbons that are not entangled with each other in the belt cross section are determined by image analysis of the SEM image. Here, the number of measurement samples (that is, the number of SEM images to be image-analyzed) is 5. The "content A of the specific aggregate" is the arithmetic mean value of the 5 samples of the "total area of the specific aggregate in the belt cross section" determined by the above method. Also, the "content B of the fibrous carbons that are not entangled with each other" is the arithmetic mean value of 5 samples of the "total area of the fibrous carbons that are not entangled with each other, in the belt cross section" determined by the above method.

Moreover, the ratio (A/(A+B)) is calculated from the "content A of the specific aggregate" and the "content B of the fibrous carbons that are not entangled with each other" obtained as described above. In a case of calculating the ratio (A/(A+B)), in a case where the specific aggregate and the fibrous carbons that are not entangled with each other have different specific gravities, the content A and the content B may be corrected using the respective specific gravities.

Resin

The first exemplary embodiment of the belt according to the present disclosure includes the resin.

The resin contained in the first exemplary embodiment of the belt according to the present disclosure is not particularly limited, and a resin appropriate for a use of the belt may be selected.

The resin contained in the first exemplary embodiment of the belt according to the present disclosure is, for example, a heat-resistant resin.

Examples of the resin include a heat-resistant resin or the like with high heat resistance and high strength, such as a liquid crystal material such as polyimide, aromatic polyamide, and a thermotropic liquid crystal polymer. Polyester, polyethylene terephthalate, polyethersulfone, polyetherketone, polysulfone, polyimideamide, and the like are used in addition to the resins.

Among these, as the resin, for example, the polyimide is preferable.

In the first exemplary embodiment of the belt according to the present disclosure, for example, polyimide, which is a heat-resistant resin, is preferable from the viewpoint of heat resistance.

Examples of the polyimide include an imidized product of a polyamic acid (precursor of a polyimide resin) which is a polymer of a tetracarboxylic acid dianhydride and a diamine compound. Specific examples of the polyimide include a resin obtained by polymerizing equimolar amounts of the tetracarboxylic acid dianhydride and the diamine compound in a solvent to obtain a polyamic acid solution, and then imidizing the polyamic acid.

Examples of the tetracarboxylic acid dianhydride include both an aromatic compound and an aliphatic compound. From the viewpoint of heat resistance, for example, the aromatic compound is preferable.

Examples of the aromatic tetracarboxylic acid dianhydride include pyromellitic acid dianhydride, 3,3',4,4'-benzophenone tetracarboxylic acid dianhydride, 3,3',4,4'-biphenyl sulfone tetracarboxylic acid dianhydride, 1,4,5,8-naphthalene tetracarboxylic acid dianhydride, 2,3,6,7-naphthalene tetracarboxylic acid dianhydride, 3,3',4,4'-biphenyl ether tetracarboxylic acid dianhydride, 3,3',4,4'-dimethyldiphenylsilane tetracarboxylic acid dianhydride, 3,3',4,4'-tetraphenylsilane tetracarboxylic acid dianhydride, 1,2,3,4-furantetracarboxylic acid dianhydride, 4,4'-bis(3,4-dicarboxyphenoxy) diphenylsulfide dianhydride, 4,4'-bis(3,4-dicarboxyphenoxy) diphenylsulfone dianhydride, 4,4'-bis(3,4-dicarboxyphenoxy) diphenylpropane dianhydride, 3,3',4,4'-perfluoroisopropylidene diphthalic acid dianhydride, 3,3',4,4'-biphenyl tetracarboxylic acid dianhydride, 2,3,3',4'-biphenyl tetracarboxylic acid dianhydride, bis(phthalic acid) phenylphosphine oxide dianhydride, p-phenylene-bis(triphenylphthalic acid) dianhydride, m-phenylene-bis(triphenylphthalic acid) dianhydride, bis(triphenylphthalic acid)-4,4'-diphenyl ether dianhydride, and bis(triphenylphthalic acid)-4,4'-diphenyl methane dianhydride.

Examples of the aliphatic tetracarboxylic acid dianhydride include an aliphatic or alicyclic tetracarboxylic acid dianhydride such as butanetetracarboxylic acid dianhydride, 1,2,3,4-cyclobutanetetracarboxylic acid dianhydride, 1,3-dimethyl-1,2,3,4-dyclobutanetetracarboxylic acid dianhydride, 1,2,3,4-cyclopentanetetracarboxylic acid dianhydride, 2,3,5-tricarboxycyclopentylacetic acid dianhydride, 3,5,6-tricarboxyorbornane-2-acetic acid dianhydride, 2,3,4,5-tetrahydrofuran tetracarboxylic acid dianhydride, 5-(2,5-dioxotetrahydrofuryl)-3-methyl-3-cyclohexene-1,2-dicarboxylic acid dianhydride, and bicyclo [2,2,2]-oct-7-ene-2,3,5,6-tetracarboxylic acid dianhydrides; and an aliphatic tetracarboxylic dianhydride having an aromatic ring such as 1,3,3a,4,5,9b-hexahydro-2,5-dioxo-3-furanyl)-naphtho[1,2-c]furan-1,3-dione, 1,3,3a,4,5,9b-hexahydro-5-methyl-5-(tetrahydro-2,5-dioxo-3-furanyl)-naphtho[1,2-c]furan-1,3-dione, and 1,3,3a,4,5,9b-hexahydro-8-methyl-5-(tetrahydro-2,5-dioxo-3-furanyl)-naphtho[1,2-c]furan-1,3-dione.

Among these, as the tetracarboxylic acid dianhydride, the aromatic tetracarboxylic acid dianhydride may be used. Specifically, for example, the pyromellitic acid dianhydride, the 3,3',4,4'-biphenyl tetracarboxylic acid dianhydride, the 2,3,3',4'-biphenyl tetracarboxylic acid dianhydride, the 3,3',4,4'-biphenyl ether tetracarboxylic acid dianhydride, and the 3,3',4,4'-benzophenone tetracarboxylic acid dianhydride may be used. Further, pyromellitic acid dianhydride, the 3,3',4,4'-biphenyl tetracarboxylic acid dianhydride, and the 3,3',4,4'-benzophenone tetracarboxylic acid dianhydride may be used. In particular, the 3,3',4,4'-biphenyl tetracarboxylic acid dianhydride may be used.

The tetracarboxylic acid dianhydride may be used alone or two or more kinds thereof may be used in combination.

Further, in a case where two or more kinds of the tetracarboxylic acid dianhydrides are used in combination, each of the aromatic tetracarboxylic acid dianhydrides and the aliphatic tetracarboxylic acid dianhydrides may be used in combination, and the aromatic tetracarboxylic acid dianhydride and the aliphatic tetracarboxylic acid dianhydride may be combined.

On the other hand, the diamine compound is a diamine compound having two amino groups in a molecular structure. Examples of the diamine compound include both an aromatic compound and an aliphatic compound, and for example, the aromatic compound is preferable.

Examples of the diamine compound include an aromatic diamine such as p-phenylenediamine, m-phenylenediamine, 4,4'-diaminodiphenylmethane, 4,4'-diaminodiphenylethane, 4,4'-diaminodiphenyl ether, 4,4'-diaminodiphenyl sulfide, 4,4'-diaminodiphenyl sulfone, 1,5-diaminonaphthalene, 3,3-dimethyl-4,4'-diaminobiphenyl, 5-amino-1-(4'-aminophenyl)-1,3,3-trimethylindane, 6-amino-1-(4'-aminophenyl)-1,3,3-trimethylindane, 4,4'-diaminobenzanilide, 3,5-diamino-3'-trifluoromethylbenzanilide, 3,5-diamino-4'-trifluoromethylbenzanilide, 3,4'-diaminodiphenyl ether, 2,7-diaminofluorene, 2,2-bis(4-aminophenyl) hexafluoropropane, 4,4'-methylene-bis(2-chloroaniline), 2,2', 5,5'-tetrachloro-4,4'-diaminobiphenyl, 2,2'-dichloro-4,4'-diamino-5,5'-dimethoxybiphenyl, 3,3'-dimethoxy-4,4'-diaminobiphenyl, 4,4'-diamino-2,2'-bis(trifluoromethyl)biphenyl, 2,2-bis[4-(4-aminophenoxy)phenyl]propane, 2,2-bis[4-(4-aminophenoxy)phenyl]hexafluoropropane, 1,4-bis(4-aminophenoxy)benzene, 4,4'-bis(4-aminophenoxy)-biphenyl, 1,3'-bis(4-aminophenoxy)benzene, 9,9-bis(4-aminophenyl)fluorene, 4,4'-(p-phenylene isopropylidene) bisaniline, 4,4'-(m-phenylene isopropylidene)bisaniline, 2,2'-bis[4-(4-amino-2-trifluoromethylphenoxy)phenyl] hexafluoropropane, and 4,4'-bis[4-(4-amino-2-trifluoromethyl)phenoxy]-octafluorobiphenyl; an aromatic diamine, having two amino groups bonded to an aromatic ring and a hetero atom other than a nitrogen atom of the amino groups, such as diaminotetraphenylthiophene; and an aliphatic diamine and an alicyclic diamine such as 1,1-m-xylylenediamine, 1,3-propane diamine, tetramethylenediamine, pentamethylenediamine, octamethylenediamine, nonamethylenediamine, 4,4-diaminoheptamethylenediamine, 1,4-diaminocyclohexane, isophorone diamine, tetrahydrodicyclopentadienylenediamine, hexahydro-4,7-methanoin danylene dimethylenediamine, tricyclo[6,2,1,$0^{27}$]-undecylenic methyldiamine, and 4,4'-methylene bis(cyclohexylamine).

Among these, as the diamine compound, the aromatic diamine compound may be used. Specifically, for example, the p-phenylenediamine, the m-phenylenediamine, the 4,4'-diaminodiphenylmethane, the 4,4'-diaminodiphenyl ether, the 3,4'-diaminodiphenyl ether, the 4,4'-diaminodiphenyl sulfide, and the 4,4'-diaminodiphenyl sulfone may be used. In particular, the 4,4'-diaminodiphenyl ether and the p-phenylenediamine may be used.

The diamine compound may be used alone or two or more kinds thereof may be used in combination.

In addition, in a case where two or more kinds of the diamine compound are used in combination, each of the aromatic diamine compounds and the aliphatic diamine compounds may be used in combination, and the aromatic diamine compound and the aliphatic diamine compound may be combined.

Among these, from the viewpoint of heat resistance, the polyimide is, for example, preferably the aromatic polyimide (specifically, an imidized product of a polyamic acid (precursor of a polyimide resin) which is a polymer of an aromatic tetracarboxylic acid dianhydride and an aromatic diamine compound.

The aromatic polyimide is, for example, more preferably a polyimide having a structural unit represented by the following General Formula (PI1).

(PI1)

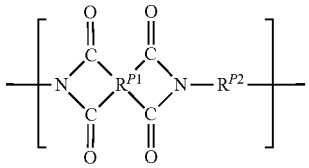

In General Formula (PI1), RP—represents a phenyl group or a biphenyl group, and $RP^2$ represents a divalent aromatic group.

Examples of the divalent aromatic group represented by $R^{P2}$ include a phenylene group, a naphthyl group, a biphenyl group, and a diphenyl ether group. From the viewpoint of bending durability, as the divalent aromatic group, for example, the phenylene group and the biphenyl group are preferable.

The number average molecular weight of the polyimide may be 5,000 or more and 100,000 or less, for example, more preferably 7,000 or more and 50,000 or less, and still more preferably 10,000 or more and 30,000 or less.

The number average molecular weight of the polyimide is measured by a gel permeation chromatography (GPC) method under the following measurement conditions.

Column: Tosoh TSK gel α-M (7.8 mm I.D×30 cm)

Eluent: DMF (dimethylformamide)/30 mM LiBr/60 mM phosphoric acid

Flow velocity: 0.6 mL/min

Injection amount: 60 μL

Detector: RI (differential refractive index detector)

In the first exemplary embodiment of the belt according to the present disclosure, a content of the resin is, for example, preferably 70% by mass or more, more preferably 80% by mass or more, still more preferably 85% by mass or more, and particularly preferably 90% by mass or more, with respect to a total mass of the belt.

Additive

The first exemplary embodiment of the belt according to the present disclosure may include a well-known additive such as a filler and a lubricant, in addition to the resin, the specific aggregate, and the fibrous carbons that are not entangled with each other.

Belt Shape

A diameter, a width, and a film thickness of the first exemplary embodiment of the belt according to the present disclosure may be appropriately determined according to the use.

Further, the belt according to the present disclosure is, for example, preferably an endless belt (also referred to as a seamless belt) , from the viewpoints of increasing application selectivity, increasing bending durability, and the like. Here, the endless belt refers to a belt in which both end portions of the belt are joined and which has no joint.

The film thickness of the belt according to the present disclosure is, for example, 20 μm or more and 150 μm or less, preferably 30 μm or more and 120 μm or less, and more preferably 40 μm or more and 100 μm or less.

The film thickness of the belt is measured as follows.

That is, the film thickness of the belt to be measured is measured at the following measurement positions.

First, a total width of the belt is measured at 5 mm intervals along an axial direction of the belt. In addition, the measurement positions in a circumferential direction of the belt are four points at 90° intervals.

An eddy current type film thickness meter ISOSCOPE MP30 manufactured by Fisher Instruments K. K. is used to measure the film thickness of the belt.

Physical Property of Belt

Thermal Conductivity

As described above, the first exemplary embodiment of the belt according to the present disclosure has high thermal conductivity.

In the first exemplary embodiment of the belt according to the present disclosure, for example, the thermal conductivity is preferably 0.5 W/m·K or more and 10 W/m·K or less, more preferably 0.6 W/m·K or more and 10 W/m·K or less, and still more preferably 0.8 W/m·K or more and 10 W/m·K or less.

The thermal conductivity of the belt is measured as follows.

That is, a flat plate-shaped test piece is cut out from a target belt, and the thermal conductivity is determined from a thermal diffusivity in a thickness direction of the test piece. Specifically, after placing the test piece on a probe of a thermal conductivity measuring device Eye Phase Mobile (manufactured by ai Phase Co.), a weight of 50 gf is placed, and the thermal conductivity is measured three times in a manual mode, under conditions of 1.41 V, 10 divisions of 3 Hz to 100 Hz, and a measurement time of 2 seconds. The arithmetic mean value of the three measurement values is taken as the thermal conductivity of the belt.

Tensile Elongation

As described above, the first exemplary embodiment of the belt according to the present disclosure has excellent bending durability.

In the first exemplary embodiment of the belt according to the present disclosure, for example, the tensile elongation is preferably 5% or more and 40% or less, more preferably 7% or more and 40% or less, and still more preferably 10% or more and 40% or less.

The tensile elongation of the belt is measured as follows.

First, a dumbbell-shaped test piece having a constriction width of 5 mm is cut out from a target belt. The sample piece is subjected to a tensile test at a speed of 10 mm/min using a load tester (manufactured by Aikoh Engineering Co., Ltd.), and the tensile elongation is determined as an elongation rate when the test piece breaks with respect to the test piece at the start of the test.

Second Exemplary Embodiment of Belt

The second exemplary embodiment of the belt according to the present disclosure is a belt including a resin and a fibrous carbon, in which a thermal conductivity is 0.5 W/m·K or more and 10 W/m·K or less, and a tensile elongation is 5% or more and 40% or less.

The second exemplary embodiment of the belt according to the present disclosure has a high thermal conductivity and an excellent bending durability, as is clear from configuration.

In the second exemplary embodiment of the belt according to the present disclosure, for example, it is preferable that the thermal conductivity is 0.6 W/m·K or more and 10 W/m·K or less and the tensile elongation is 7% or more and 40% or less, and it is more preferable that the thermal conductivity is 0.8 W/m·K or more and 10 W/m·K or less and the tensile elongation is 10% or more and 40% or less.

The second exemplary embodiment of the belt according to the present disclosure, for example, preferably contains the resin and a specific aggregate as the fibrous carbon, similarly to the first exemplary embodiment of the belt according to the present disclosure, and more preferably contains the resin, the specific aggregate, and the fibrous carbons that are not entangled with each other.

Each of the resin, the specific aggregate, and the fibrous carbons that are not entangled with each other in the second exemplary embodiment is the same as an aspect of the first exemplary embodiment.

Further, the second exemplary embodiment of the belt according to the present disclosure may also contain a well-known additive.

Further, a shape of the second exemplary embodiment of the belt according to the present disclosure may be appropriately determined according to the use, as in the first exemplary embodiment of the belt according to the present disclosure.

Further, the second exemplary embodiment of the belt according to the present disclosure is also, for example, preferably an endless belt (also referred to as a seamless belt), from the viewpoints of increasing application selectivity, increasing bending durability, and the like.

Manufacturing Method

The belt according to the present disclosure is manufactured by the following method.

That is, the belt according to the present disclosure is obtained by preparing a coating liquid containing each component configuring the belt, applying the obtained coating liquid onto a cylindrical base material, and drying the coating liquid. The coating liquid contains a resin, a specific aggregate, other components used as necessary (such as fibrous carbons that are not entangled with each other and an additive), and the like.

In a case where the resin is polyimide, the belt according to the present disclosure is obtained by preparing a coating liquid containing a polyamic acid (precursor of a polyimide resin), a specific aggregate, and other components used as necessary (such as fibrous carbons that are not entangled with each other and an additive), and the like, applying the obtained coating liquid onto a cylindrical base material, and firing (that is, imidizing) the coating liquid.

In a case of preparing the coating liquid, for example, the specific aggregate is preferably manufactured as well.

Specifically, examples of the method include a method in which a precursor liquid containing a resin and a fibrous carbon is prepared (also referred to as a precursor liquid preparation step), a specific aggregate is produced in a system of the precursor liquid (also referred to as a specific aggregate production step), and the coating liquid containing the resin and the specific aggregate is obtained.

Hereinafter, the precursor liquid preparation step and the specific aggregate production step will be described.

Precursor Liquid Preparation Step

In the precursor liquid preparation step, first, the fibrous carbon and a dispersion medium are, for example, preferably mixed to prepare a dispersion liquid in which the fibrous carbons are dispersed.

Here, examples of the dispersion medium include an organic solvent that does not dissolve or is difficult to dissolve the fibrous carbon, and can dissolve the resin. For example, in a case where a polyamic acid (precursor of a polyimide resin) is used as the resin, examples of the dispersion medium include N-methyl-2-pyrrolidone (NMP) and dimethyl sulfoxide (DMSO).

Here, the content of fibrous carbon in the dispersion liquid is 0.1% by mass or more and 10% by mass or less (for example, preferably 0.3% by mass or more and 5% by mass or less) with respect to the total mass of the dispersion liquid.

The obtained dispersion liquid is, for example, preferably subjected to a high-pressure dispersion treatment. By performing the high-pressure dispersion treatment, the fibrous carbon is loosened in the dispersion liquid and isolated individually, and further the length of the fibrous carbon in the dispersion liquid is adjusted.

Here, the conditions for the high-pressure dispersion treatment may be any condition under which the fibrous carbons are individually isolated and the length of the fibrous carbons may be adjusted to a target value. For example, the high-pressure dispersion treatment is preferably performed at a liquid temperature of the dispersion liquid of 25° C. or higher and 90° C. or lower and under a pressure of 1 MPa or higher and 100 MPa or lower (for example, preferably 3 MPa or higher and 80 MPa or lower).

A high-pressure homogenizer or the like is used for the high-pressure dispersion treatment.

The length of the fibrous carbon in the dispersion liquid is adjusted to, for example, preferably about 1 μm or more and 100 μm or less (for example, preferably 3 μm or more and 50 μm or less).

Here, the length of the fibrous carbon in the dispersion liquid may be measured by observation with an optical microscope or an electron microscope.

The maximum diameter of the specific aggregate may be controlled by the length of the fibrous carbon in the dispersion liquid. Specifically, as the fibrous carbon is longer, the aggregate having a larger maximum diameter tends to be produced.

In the precursor liquid preparation step, a resin is subsequently added to the dispersion liquid obtained as described above to prepare a precursor liquid.

The amount of the resin added is, for example, preferably set to about 1% by mass or more and 20% by mass or less (for example, preferably 3% by mass or more and 15% by mass or less) with respect to the total mass of the dispersion liquid.

Specific Aggregate Manufacturing Step

In the specific aggregate manufacturing step, the precursor liquid obtained in the precursor liquid preparation step is agitated with a planetary mixer to manufacture a specific aggregate in the system.

By agitating the precursor liquid with a planetary mixer, the fibrous carbons individually isolated in the precursor liquid are slowly entangled into a lump, and a specific aggregate is produced.

Here, a condition of agitating by the planetary mixer may be a condition under which a specific aggregate having a target maximum diameter may be obtained.

For example, as the condition of agitating, it is preferable that the liquid temperature of the precursor liquid is 25° C. or higher and 60° C. or lower, and the agitating is performed for 3 minutes to 90 minutes.

The maximum diameter of the specific aggregate may be controlled by the condition of agitating. Specifically, as the time for agitating by the planetary mixer is longer, the aggregate having a larger maximum diameter tends to be produced.

In the specific aggregate production step, all of the fibrous carbons contained in the precursor liquid may become specific aggregates, and together with the specific aggregates, some of the fibrous carbons which do not form the specific aggregates (that is, the fibrous carbons that are not entangled with each other) may remain.

As described above, a mixture liquid containing the resin and the specific aggregate may be obtained.

By adding other components (such as fibrous carbons that are not entangled with each other and an additive) to the obtained mixture liquid, as needed, a coating liquid used for manufacturing a belt may be obtained. Further, the obtained mixture liquid may be diluted with an organic solvent to adjust viscosity or the like of the coating liquid.

The ratio (minor axis Y/major axis X) of a minor axis Y to a major axis X of the specific aggregate may be controlled by a solid content concentration in the coating liquid. Specifically, as the solid content concentration in the coating liquid, an aggregate having smaller value of the ratio (minor axis Y/major axis X) tends to be produced.

Fixing Belt

The fixing belt according to the present disclosure is a fixing belt having at least one of an elastic layer or a surface layer on the belt according to the present disclosure.

That is, the fixing belt according to the present disclosure uses the belt according to the present disclosure as a base material layer, and includes at least one of an elastic layer or a surface layer on the base material layer.

Since the fixing belt according to the present disclosure has the belt according to the present disclosure having high thermal conductivity and excellent bending durability, it is possible to shorten the heating time, reduce power consumption, increase fixing speed, and the like, and service life may be further extended.

The fixing belt according to the present disclosure will be described with reference to FIG. 1.

FIG. 1 is a schematic cross sectional diagram showing an example of the fixing belt according to the present disclosure.

A fixing belt 110 shown in FIG. 1 includes a base material layer 110A, an elastic layer 110B provided on the base material layer 110A, and a surface layer 110C provided on the elastic layer 110B.

A layer structure of the fixing belt 110 according to the present disclosure is not limited to the layer structure shown in FIG. 1, and may also be a layer structure in which an adhesive layer is interposed between the base material layer 110A and the elastic layer 110B, a layer structure in which an adhesive layer is interposed between the elastic layer 110B and the surface layer 110C, a layer structure having no elastic layer 110B, a layer structure having no surface layer 110C, and a layer structure combining these layer structures.

Hereinafter, components of the fixing belt according to the present disclosure will be described in detail. The description will be made without reference numerals.

Base Material Layer

In the fixing belt according to the present disclosure, the belt according to the present disclosure is used as a base material layer.

The film thickness of the base material layer in the fixing belt according to the present disclosure is, for example, preferably 20 μm or more and 200 μm or less, more preferably 30 μm or more and 150 μm or less, and particularly preferably 40 μm or more and 120 μm or less, from the viewpoints of thermal conductivity and bending durability.

The belt manufacturing method according to the present disclosure described above may be applied to form the base material layer.

Elastic Layer

The fixing belt according to the present disclosure has, for example, an elastic layer on a base material layer (that is, the belt according to the present disclosure).

The elastic layer may be a layer having elasticity and is not particularly limited.

The elastic layer is a layer provided in the viewpoint of imparting elasticity to a pressure applied to the fixing belt from an outer peripheral side, and plays a role of bringing the surface of the fixing belt into close contact with the toner image by following unevenness of a toner image on a recording medium.

The elastic layer may be configured of, for example, an elastic material that restores an original shape even in a case where the material is deformed by applying an external force of 100 Pa.

Examples of the elastic material used for the elastic layer include a fluororesin, a silicone resin, a silicone rubber, a fluororubber, and a fluorosilicone rubber. As the material of the elastic layer, for example, the silicone rubber and the fluororubber are preferable, and the silicone rubber is more preferable, from the viewpoints of heat resistance, thermal conductivity, insulation, and the like.

Examples of the silicone rubber include RTV silicone rubber, HTV silicone rubber, and liquid silicone rubber. Specific examples thereof include polydimethyl silicone rubber (MQ), methyl vinyl silicone rubber (VMQ), methylphenyl silicone rubber (PMQ), and fluorosilicone rubber (FVMQ).

As the silicone rubber, for example, it is preferable to use a silicone rubber in which most of crosslinking-forms are addition reaction types. In addition, various types of functional groups are known for the silicone rubber. For example, dimethyl silicone rubber having a methyl group, methylphenyl silicone rubber having a methyl group and a phenyl group, and vinyl silicone rubber having a vinyl group (vinyl group-containing silicone rubber) are preferably used.

Further, as the silicone rubber, for example, a vinyl silicone rubber having a vinyl group is more preferable. For example, a silicone rubber having an organopolysiloxane structure having a vinyl group and a hydrogen organopolysiloxane structure having a hydrogen atom (SiH) bonded to a silicon atom is still more preferable.

Examples of the fluororubber include vinylidene fluoride rubber, ethylene/propylene tetrafluoride rubber, ethylene/perfluoromethyl tetrafluoride vinyl ether rubber, phosphazene rubber, and fluoropolyether.

The elastic material used for the elastic layer contains, for example, preferably silicone rubber as a major component (that is, contains 50% by mass or more of silicone rubber with respect to the total mass of the elastic material).

The content of the silicone rubber is, for example, more preferably 90% by mass or more, still more preferably 99% by mass or more, and may also be 100% by mass, with respect to the total mass of the elastic material used for the elastic layer.

The elastic layer may further contain an inorganic filler for the purpose of reinforcement, heat resistance, heat transfer, and the like, in addition to the elastic material. Examples of the inorganic filler include known fillers, and for example, fuming silica, crystalline silica, iron oxide, alumina, and metallic silicon are preferable.

Examples of the material of the inorganic filler include, in addition to the above, known inorganic fillers such as carbides (such as carbon black, carbon fiber, and carbon nanotubes), titanium oxide, silicon carbide, talc, mica, kaolin, calcium carbonate, calcium silicate, magnesium oxide, graphite, silicon nitride, boron nitride, cerium oxide, and magnesium carbonate.

Among these, for example, the silicon nitride, the silicon carbide, the graphite, the boron nitride, and the carbides are preferable, from the viewpoint of thermal conductivity.

The content of the inorganic filler in the elastic layer may be determined according to the required thermal conductivity, mechanical strength, and the like. For example, the content is, for example, 1% by mass or more and 20% by mass or less, preferably 3% by mass or more and 15% by mass, and more preferably 5% by mass or more and 10% by mass or less.

Further, the elastic layer may contain, as the additive, for example, a softening agent (such as paraffin-based softening agent), a processing aid (such as stearic acid), an anti-aging agent (such as amine-based anti-aging agent), a vulcanizing agent (such as sulfur, metal oxide, and peroxide).

The thickness of the elastic layer is, for example, preferably 30 μm or more and 600 μm or less, and more preferably 100 μm or more and 500 μm or less.

A known method may be applied to form the elastic layer, for example, a coating method is applied.

In a case where the silicone rubber is used as the elastic material of the elastic layer, for example, first, an elastic layer-forming coating liquid containing a liquid silicone rubber that is cured by heating to become a silicone rubber is prepared. Next, the elastic layer-forming coating liquid is applied onto the base material layer to form a coating film, and as needed, the coating film is vulcanized to form an elastic layer on the base material layer. In the vulcanization of the coating film, the vulcanization temperature is, for example, 150° C. or higher and 250° C. or lower, and the vulcanization time is, for example, 30 minutes or longer and 120 minutes or shorter.

Surface Layer

The fixing belt according to the present disclosure has, for example, a surface layer on the base material layer or the elastic layer.

The surface layer is a layer that plays a role of suppressing the toner image in a molten state from sticking to the surface (outer peripheral surface) on a side in contact with the recording medium at the time of fixing.

The surface layer is required to have, for example, heat resistance and releasability. From the viewpoint, for the material configuring the surface layer, for example, a heat-resistant release material is preferably used, and specific examples thereof include fluororubber, fluororesin, silicone resin, and polyimide resin.

Among these, for example, the fluororesin may be used as the heat-resistant release material.

Specific examples of the fluororesin include a tetrafluoroethylene-perfluoroalkyl vinyl ether copolymer (PFA), polytetrafluoroethylene (PTFE), a tetrafluoroethylene-hexafluoropropylene copolymer (FEP), a polyethylene-tetrafluoro ethylene copolymer (ETFE), polyvinylidene fluoride (PVDF), polychlorotrifluoroethylene (PCTFE), and vinyl fluoride (PVF).

The surface of the surface layer on the elastic layer side may be subjected to a surface treatment. The surface treatment may be a wet treatment or a dry treatment, and examples thereof include a liquid ammonia treatment, an excimer laser treatment, and a plasma treatment.

The thickness of the surface layer is, for example, preferably 10 μm or more and 100 μm or less, and more preferably 20 μm or more and 50 μm or less.

A known method may be applied to form the surface layer, and for example, a coating method may be applied.

Further, the surface layer may be formed by preparing a tubular surface layer in advance and coating the outer periphery of the elastic layer with the surface layer. An adhesive layer (for example, an adhesive layer containing a silane coupling agent having an epoxy group) may be formed on an inner surface of the tubular surface layer and then the outer periphery may be coated therewith.

The film thickness of the fixing belt according to the present disclosure is, for example, preferably 0.06 mm or more and 0.90 mm or less, more preferably 0.08 mm or more and 0.70 mm or less, and further preferably 0.10 mm or more and 0.60 mm or less.

Use of Fixing Belt Member

The fixing belt according to the present disclosure is, for example, applied to both a heating belt and a pressure belt.

Fixing Device

The fixing device according to the present disclosure has various configurations, for example, may include a fixing device including a first rotating body and a second rotating body arranged in contact with the outer surface of the first rotating body, in which a toner image is fixed by inserting a recording medium having the toner image formed on a surface into a contact portion between the first rotating body and the second rotating body. Then, the fixing belt according to the present disclosure is applied as least one of the first rotating body or the second rotating body.

Hereinafter, the fixing device according to the present disclosure will be described as a fixing device including a heating roll and a pressure belt as a first exemplary embodiment and a fixing device including a heating belt and a heating roll as a second exemplary embodiment. Then, in the first and second exemplary embodiments, the fixing belt according to the present disclosure may be applied to both the heating belt and the pressure belt.

The fixing device according to the present disclosure is not limited to the first and second exemplary embodiments, and may be a fixing device including a heating roll or a heating belt and a pressure belt. The fixing belt according to the present disclosure may be applied to both the heating belt and the pressure belt.

First Exemplary Embodiment of Fixing Device

Figure 2:
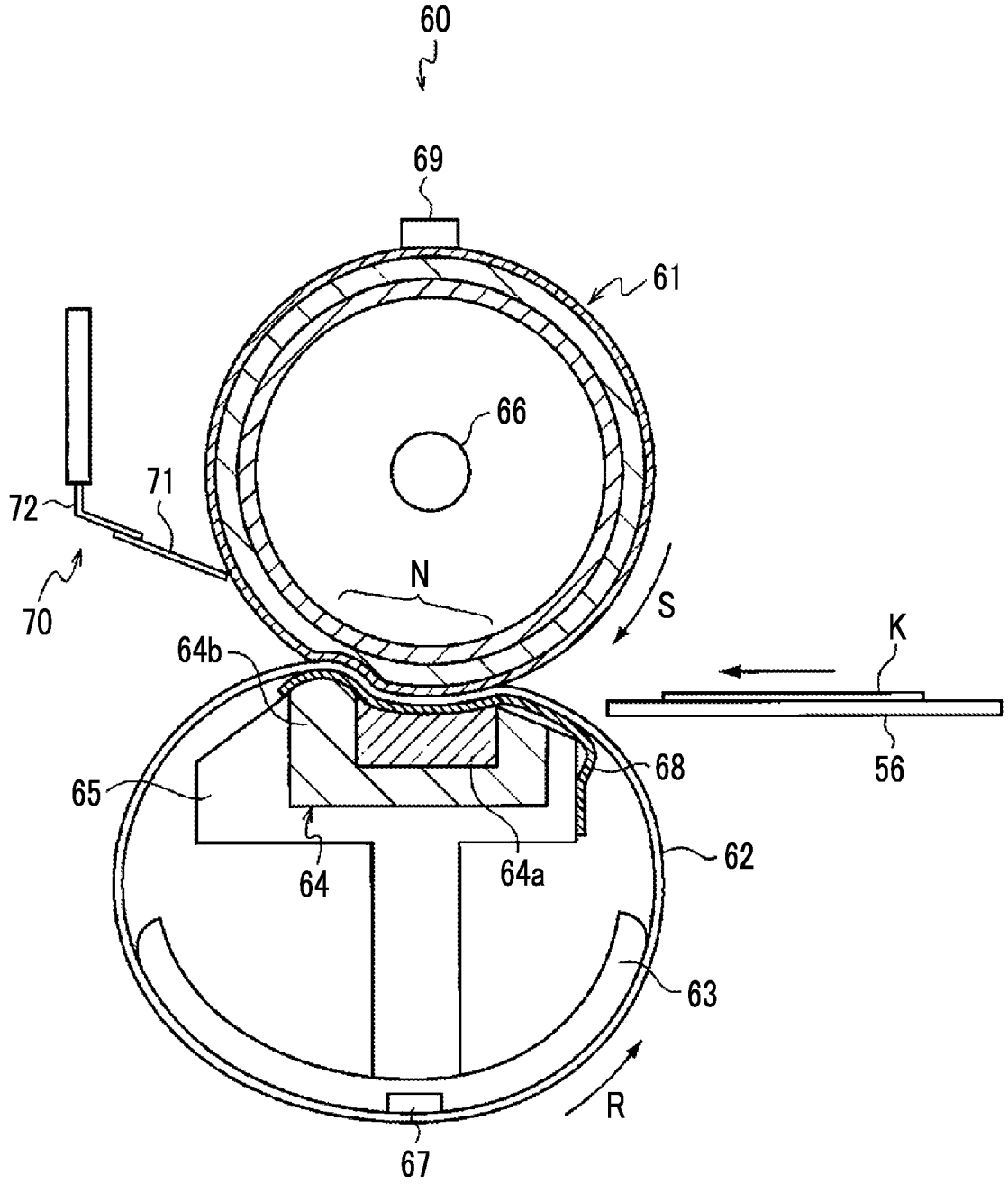
FIG. 2 is a schematic configuration diagram showing an example of a first exemplary embodiment of the fixing device according to the present disclosure.

The first exemplary embodiment of the fixing device will be described with reference to FIG. 2. FIG. 2 is a schematic diagram showing an example of a first exemplary embodiment of the fixing device (that is, a fixing device 60).

As shown in FIG. 2, the fixing device 60 is configured to include, for example, a heating roll 61 (an example of a first rotating body) driven to rotate, a pressure belt 62 (an example of a second rotating body), and a pressing pad 64 (an example of pressing member) that presses the heating roll 61 via the pressure belt 62.

Regarding the pressing pad 64, for example, the pressure belt 62 and the heating roll 61 may be relatively pressed. Therefore, a pressure belt 62 side may be pressed to the heating roll 61, and a heating roll 61 side may be pressed to the pressure belt 62.

A halogen lamp 66 (an example of heating unit) is arranged inside the heating roll 61. The heating unit is not limited to the halogen lamp, and other heat-generating members that generate heat may be used.

On the other hand, for example, a temperature sensitive element 69 is arranged in contact with the surface of the heating roll 61. The lighting of the halogen lamp 66 is controlled based on a temperature measurement value by the temperature sensitive element 69, and a surface temperature of the heating roll 61 is maintained at a target set temperature (for example, 150° C.)

The pressure belt 62 is rotatably supported by, for example, a pressing pad 64 arranged therein and a belt traveling guide 63. In a sandwiching region N (nip portion), the pressure belt is arranged by being pressed against the heating roll 61 by the pressing pad 64.

The pressing pad 64 is arranged in a state of being pressed to the heating roll 61 via the pressure belt 62 inside the pressure belt 62, and forms a sandwiching region N with the heating roll 61, for example.

In the pressing pad 64, for example, a front sandwiching member 64*a* for securing a wide sandwiching region N is arranged on an inlet side of the sandwiching region N, and a peeling sandwiching member 64*b* for giving distortion to the heating roll 61 is arranged on an outlet side of the sandwiching region N.

In order to reduce sliding resistance between an inner peripheral surface of the pressure belt 62 and the pressing pad 64, for example, a sheet-like sliding member 68 is provided on a surface of the front sandwiching member 64*a* and the peeling sandwiching member 64*b* in contact with the pressure belt 62. The pressing pad 64 and the sliding member 68 are held by a metal holding member 65.

The sliding member 68 is provided, for example, so that a sliding surface thereof is in contact with an inner peripheral surface of the pressure belt 62, and is involved in holding and supplying an oil existing between the sliding member 68 and the pressure belt 62.

For example, a belt traveling guide 63 is attached to the holding member 65, and the pressure belt 62 is configured to rotate.

The heating roll 61 rotates, for example, in a direction of an arrow S by a drive motor (not shown) , and the pressure belt 62 rotates by being driven the rotation of the heating roll 61, in a direction of an arrow R opposite to the rotation direction of the heating roll 61. That is, for example, the heating roll 61 rotates clockwise in FIG. 2, while the pressure belt 62 rotates counterclockwise.

Then, paper K (an example of the recording medium) having an unfixed toner image is guided by, for example, the fixing inlet guide 56 and transported to the sandwiching region N. In a case where the paper K passes through the sandwiching region N, the unfixed toner image on the paper K is fixed by the pressure and heat acting on the sandwiching region N.

In the fixing device 60, for example, a concave front sandwiching member 64*a* that follows the outer peripheral surface of the heating roll 61 secures a wider sandwiching region N as compared with a configuration without the front sandwiching member 64*a*.

Further, for example, by arranging the peeling sandwiching member 64*b* so as to protrude from the outer peripheral surface of the heating roll 61, the fixing device 60 is configured such that the strain of the heating roll becomes locally large in the outlet region of the sandwiching region N.

In a case where the peeling sandwiching member 64*b* is arranged in this manner, for example, the paper K after fixing passes through locally large formed strain when passing through the peeling sandwiching region, and thus the paper K is easy to be peeled off from the heating roll 61.

As an auxiliary unit for peeling, for example, a peeling member 70 is arranged on a downstream side of the sandwiching region N of the heating roll 61. The peeling member 70 is, for example, held by the holding member 72 in a state where a peeling claw 71 is close to the heating roll in a direction facing the rotation direction of the heating roll 61 (counter direction).

Second Exemplary Embodiment of Fixing Device

Figure 3:
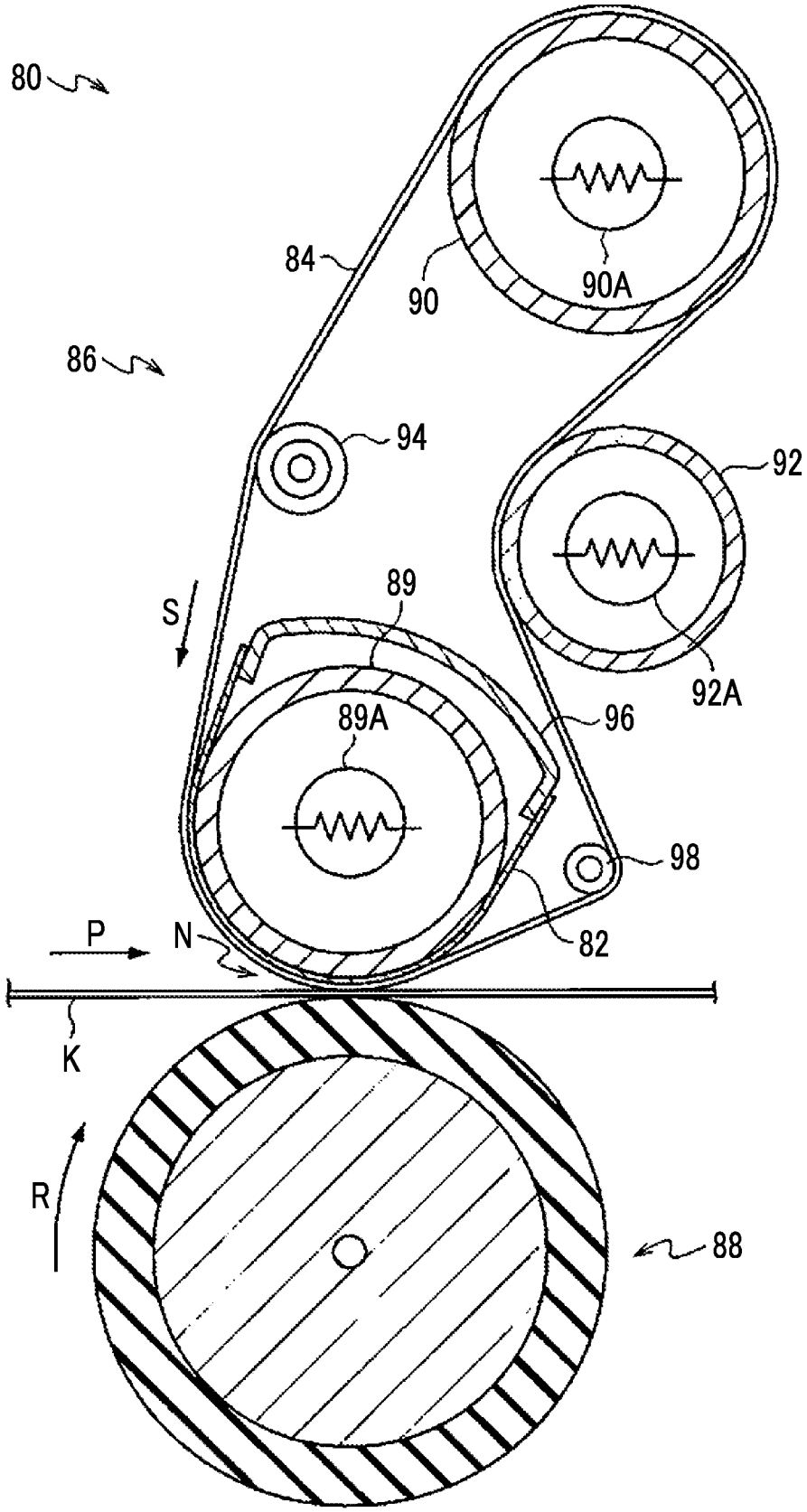
FIG. 3 is a schematic configuration diagram showing an example of a second exemplary embodiment of the fixing device according to the present disclosure.

A second exemplary embodiment of the fixing device will be described with reference to FIG. 3. FIG. 3 is a schematic diagram showing an example of a second exemplary embodiment of the fixing device (that is, a fixing device 80).

As shown in FIG. 3, the fixing device 80 is configured to include, for example, a fixing belt module 86 including a heating belt 84 (an example of the first rotating body) and a pressure roll 88 (an example of the second rotating body) arranged by being pressed to the heating belt 84 (the fixing belt module 86). For example, the sandwiching region N (nip portion) is formed in a contact portion between the heating belt 84 (fixing belt module 86) and the pressure roll 88. In the sandwiching region N, the paper K (an example of the recording medium) is pressed and heated, and the toner image is fixed.

The fixing belt module 86 includes, for example, an endless heating belt 84, a heating pressing roll 89 around which the heating belt 84 is wound on the pressure roll 88 side, and which is rotationally driven by the rotational force of a motor (not shown) and presses the heating belt from an inner peripheral surface thereof toward the pressure roll 88, and a support roll 90 that supports the heating belt 84 from the inside at a position different from the heating pressing roll 89.

The fixing belt module 86 is, for example, provided with a support roll 92 that is arranged outside the heating belt 84 and defines a circuit path thereof, and a posture correction roll 94 that corrects the posture of the heating belt 84 from the heating pressing roll 89 to the support roll 90, and a support roll 98 that applies tension to the heating belt 84 from the inner peripheral surface on the downstream side of the sandwiching region N formed by the heating belt 84 and the pressure roll 88.

The fixing belt module 86 is provided, for example, so that a sheet-shaped sliding member 82 is interposed between the heating belt 84 and the heating pressing roll 89.

The sliding member 82 is provided, for example, so that a sliding surface thereof is in contact with an inner peripheral surface of the heating belt 84, and is involved in holding and supplying an oil existing between the sliding member 82 and the heating belt 84.

Here, the sliding member 82 is provided, for example, in a state where both ends thereof are supported by the support member 96.

Inside the heating pressing roll 89, for example, a halogen heater 89A (an example of heating unit) is provided.

The support roll 90 is, for example, a cylindrical roll formed of aluminum, and a halogen heater 90A (an example of heating unit) is arranged inside, so that the heating belt 84 is heated from the inner peripheral surface side.

At both ends of the support roll 90, for example, spring members (not shown) that press the heating belt 84 outward are arranged.

The support roll 92 is, for example, a cylindrical roll made of aluminum, and a release layer consisting of a fluororesin having a thickness of 20 μm is formed on a surface of the support roll 92.

The release layer of the support roll 92 is formed, for example, to prevent a toner or a paper dust from the outer peripheral surface of the heating belt 84 from accumulating on the support roll 92.

For example, a halogen heater 92A (an example of the heating unit) is arranged inside the support roll 92 so that the heating belt 84 is heated from the outer peripheral surface side.

That is, for example, the heating pressing roll 89, the support roll 90, and the support roll 92 are configured to heat the heating belt 84.

The posture correction roll 94 is, for example, a columnar roll formed of aluminum, and an end position measurement mechanism (not shown) for measuring the end position of the heating belt 84 is arranged in the vicinity of the posture correction roll 94.

The posture correction roll 94 is provided with, for example, an axial displacement mechanism (not shown) that displaces a contact position of the heating belt 84 in an axial direction according to the measurement result of the end position measuring mechanism, and is configured to control meandering of the heating belt 84.

On the other hand, the pressure roll 88 is provided, for example, rotatably supported, and the heating belt 84 is provided by being pressed against a portion wound around the heating pressing roll 89 by an urging unit such as a spring (not shown). As a result, as the heating belt 84 (heating pressing roll 89) of the fixing belt module 86 rotates in a direction of an arrow S, the pressure roll 88 follows the heating belt 84 (heating pressing roll 89) and moves in a direction of an arrow R.

Then, the paper K having the unfixed toner image (not shown) is transported in a direction of the arrow P and guided to the sandwiching region N of the fixing device 80. When the paper K passes through the sandwiching region N, the unfixed toner image on the paper K is fixed by the pressure and heat acting on the sandwiching region N.

In the fixing device 80, a form in which the halogen heater (halogen lamp) is adopted as an example of plural heating units has been described, but the present disclosure is not limited thereto. A radiation lamp heating element (a heating element that generates radiation (such as infrared rays) and a resistance heating element (heating element that generates Joule heat by passing an electric current through a resistor: for example, a ceramic substrate formed with a film having resistance and fired) may be adopted.

Image Forming Apparatus

Next, the image forming apparatus according to the present disclosure will be described.

The image forming apparatus according to the present disclosure includes an image holder; a charging unit that charges a surface of the image holder; an electrostatic latent image forming unit that forms an electrostatic latent image on the charged surface of the image holder; a developing unit that develops the electrostatic latent image formed on the surface of the image holder by a developer containing a toner to form a toner image; a transfer unit that transfers the toner image to a surface of a recording medium; and a fixing unit that fixes the toner image to the recording medium.

As the fixing unit, the fixing device according to the present disclosure is adopted.

Here, in the image forming apparatus according to the present disclosure, the fixing device may be made into a cartridge so as to be attached to and detached from the image forming apparatus. That is, the image forming apparatus according to the present disclosure may include the fixing device according to the present disclosure as a configuring device of a process cartridge.

Hereinafter, the image forming apparatus according to the present disclosure will be described with reference to the drawings.

Figure 4:
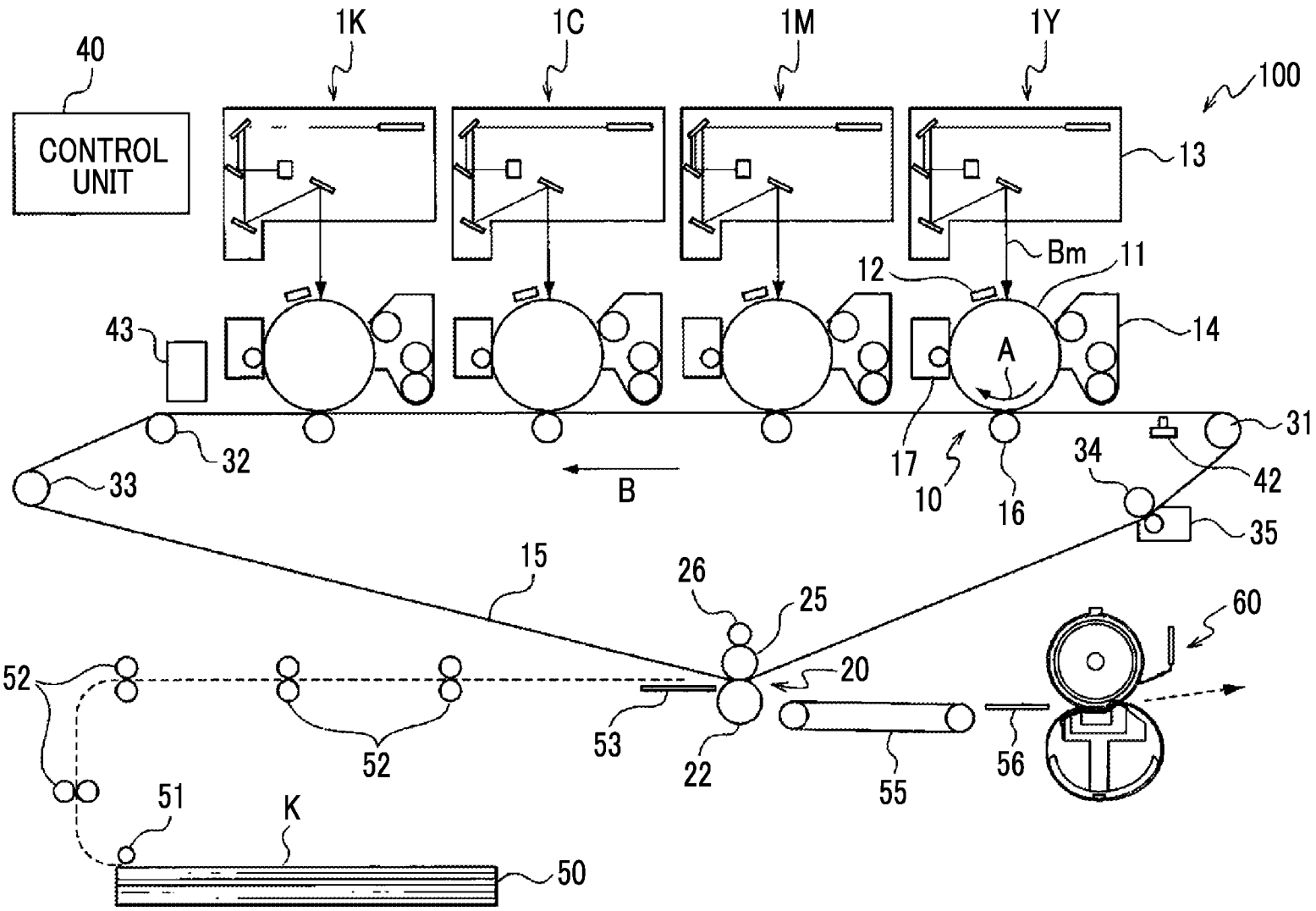
FIG. 4 is a schematic configuration diagram showing an example of an image forming apparatus according to the present disclosure.

FIG. 4 is a schematic configuration diagram showing an example of an image forming apparatus according to the present disclosure.

As shown in FIG. 4, the image forming apparatus 100 according to the present disclosure is, for example, an intermediate transfer type image forming apparatus generally called a tandem type, and includes: plural image forming units 1Y, 1M, 1C, and 1K in which each color component toner image is formed by electrophotographic method; a primary transfer unit 10 that sequentially transfers (primary transfer) each color component toner image formed by each of the image forming units 1Y, 1M, 1C, and 1K to an intermediate transfer belt 15; a secondary transfer unit 20 that collectively transfers (secondary transfer) superimposed toner image transferred on the intermediate transfer belt 15 to paper K, which is a recording medium; and a fixing device 60 that fixes a secondary transferred image on the paper K. Further, the image forming apparatus 100 has a control unit 40 that controls an operation of each device (each unit).

The fixing device 60 is the first exemplary embodiment of the fixing device described above. The image forming apparatus 100 may be configured to include the second exemplary embodiment of the fixing device described above.

Each of the image forming units 1Y, 1M, 1C, and 1K of the image forming apparatus 100 includes a photoconductor 11 that rotates in a direction of an arrow A as an example of an image holder that holds a toner image formed on the surface.

Around the photoconductor 11 as an example of a charging unit, a charger 12 that charges the photoconductor is provided and a laser exposure machine 13 (in the drawing, an exposure beam is indicated by the reference numeral Bm) that writes an electrostatic latent image on the photoconductor 11 as an example of the latent image forming unit is provided.

Further, around the photoconductor 11, a developing machine 14 in which each color component toner is accommodated and the electrostatic latent image on the photoconductor 11 is visualized by a toner is provided as an example of the developing unit, and a primary transfer roll 16 that transfers the toner image of each color component formed on the photoconductor 11 to the intermediate transfer belt 15 by the primary transfer unit 10.

Further, around the photoconductor 11, a photoconductor cleaner 17 that removes a residual toner on the photoconductor 11 is provided, and electrophotographic devices of the charger 12, the laser exposure machine 13, the developing machine 14, the primary transfer roll 16, and the photoconductor cleaner 17 are sequentially provided along the rotation direction of the photoconductor 11. These image forming units 1Y, 1M, 1C, and 1K are arranged substantially linearly in the order of yellow (Y), magenta (M), cyan (C), and black (K) from the upstream side of the intermediate transfer belt 15.

The intermediate transfer belt 15 which is an intermediate transfer body is configured of a film-shaped pressure belt in which a resin such as polyimide or polyamide is used as a base layer and an appropriate amount of an antistatic agent such as carbon black is contained. The intermediate transfer belt is formed to have a volume resistivity of $10^6$ Ωcm or more and $10^{14}$ Ωcm or less, and is configured to have a thickness of, for example, about 0.1 mm.

The intermediate transfer belt 15 is circulated (rotated) by various rolls in a B direction shown in FIG. 4 at a speed appropriate for the purpose. Examples of the various rolls include: a drive roll 31 that is driven by a motor (not shown) having excellent constant speed to rotate the intermediate transfer belt 15; a support roll 32 that supports the intermediate transfer belt 15 extending substantially linearly along the arrangement direction of each photoconductor 11; a tension applying roll 33, which applies tension to the intermediate transfer belt 15 and functions as a correction roll for preventing the intermediate transfer belt 15 from meandering; a back surface roll 25 provided on the secondary transfer unit 20; and a cleaning back surface roll 34 provided in the cleaning portion that scraps off the residual toner on the intermediate transfer belt 15.

The primary transfer unit 10 is configured of the primary transfer roll 16 arranged so as to face the photoconductor 11 with the intermediate transfer belt 15 interposed therebetween. The primary transfer roll 16 is configured of a core body and a sponge layer as an elastic layer fixed around the core body. The core body is a cylindrical rod made of a metal such as iron or SUS. The sponge layer is a sponge-like cylindrical roll which is formed of a blended rubber of NBR, SBR, and EPDM containing a conductive agent such as carbon black and has the volume resistivity of $10^{7.5}$ Ωcm or more and $10^{8.5}$ Ωcm or less.

Then, the primary transfer roll 16 is arranged to be in contact with the photoconductor 11 with the intermediate transfer belt 15 interposed therebetween, and is configured such that the primary transfer roll 16 has a charging polarity (minus polarity) of the toner and the same applies below) and the opposite polarity voltage (primary transfer bias) are applied. As a result, the toner images on the respective photoconductors 11 are sequentially electrostatically attracted to the intermediate transfer belt 15, and the superimposed toner images are formed on the intermediate transfer belt 15.

The secondary transfer unit 20 is configured to include the back surface roll 25 and the secondary transfer roll 22 arranged on the toner image holding surface side of the intermediate transfer belt 15.

In the back surface roll 25, the surface is configured of a tube of the blended rubber of EPDM and NBR rubber in which carbon is dispersed, and the inside is configured of EPDM rubber. Then, the back surface roll is formed to have the surface resistivity of $10^7$ Ω/□ or more and $10^{10}$ Ω/□ or less, and the hardness is set to, for example, 70° (ASKER C: manufactured by KOBUNSHI KEIKI Co., Ltd., the same applies below). The back surface roll 25 is arranged on the back surface side of the intermediate transfer belt 15 to form a counter electrode of the secondary transfer roll 22, and a power feeding roll 26 made of metal to which the secondary transfer bias is stably applied is contact-arranged.

The secondary transfer roll 22 is configured of a core body and a sponge layer as an elastic layer fixed around the core body. The core body is a cylindrical rod configured of a metal such as iron or SUS. The sponge layer is a sponge-like cylindrical roll which is formed of a blended rubber of NBR, SBR, and EPDM containing a conductive agent such as carbon black and has the volume resistivity of $10^{7.5}$ Ωcm or more and $10^{8.5}$ Ωcm or less.

Moreover, the secondary transfer roll 22 is arranged to be in contact with the back surface roll 25 with the intermediate transfer belt 15 interposed therebetween, and further, the secondary transfer roll 22 is grounded to form a secondary transfer bias with the back surface roll 25. The toner image is secondarily transferred onto the paper K transported to the secondary transfer unit 20.

Further, on the downstream side of the secondary transfer unit 20 of the intermediate transfer belt 15, an intermediate transfer belt cleaner 35 that cleans the surface of the intermediate transfer belt 15 by removing residual toner or paper dust on the intermediate transfer belt 15 after the secondary transfer is provided so as to be detachable from the intermediate transfer belt 15.

The intermediate transfer belt 15, the primary transfer unit 10 (primary transfer roll 16), and the secondary transfer unit 20 (secondary transfer roll 22) correspond to an example of the transfer unit.

On the other hand, on the upstream side of the yellow image forming unit 1Y, a reference sensor (home position sensor) 42 that generates a reference signal as a reference for taking the image forming timing in each of the image forming units 1Y, 1M, 1C, and 1K is provided. The reference sensor 42 recognizes a mark provided on the back side of the intermediate transfer belt 15 and generates a reference signal. According to an instruction from the control unit 40 based on the recognition of the reference signal, each of the image forming units 1Y, 1M, 1C, and 1K is configured to start image formation.

Further, on the downstream side of the black image forming unit 1K, an image density sensor 43 that adjusts an image quality is arranged.

Further, the image forming apparatus according to the present disclosure includes, as a transporting unit that transports the paper K, a paper accommodating unit 50 that accommodates the paper K; a paper feed roll 51 that takes out and transports the paper K accumulated in the paper accommodating unit 50 at a predetermined timing; a transport roll 52 that transports the paper K fed by the paper feed roll 51; a transport guide 53 that feeds the paper K transported by the transport roll 52 to the secondary transfer unit 20; a transport belt 55 that transports the paper K transported after being secondarily transferred by the secondary transfer roll 22, to the fixing device 60; and a fixing inlet guide 56 that guides the paper K to the fixing device 60.

Next, a basic image forming process of the image forming apparatus according to the present disclosure will be described.

In the image forming apparatus according to the present disclosure, image data output from an image reading device (not shown), a personal computer (PC) (not shown), or the like is subjected to image processing by an image processing device (not shown), and then the image forming units 1Y, 1M, 1C, and 1K execute an image forming work.

The image processing device performs image processing such as various image editing such as shading correction, position shift correction, brightness/color space conversion, gamma correction, frame erasing or color editing, and movement editing on the input reflectance data. The image data subjected to the image processing is converted into color material gradation data of four colors of Y, M, C, and K, and is output to the laser exposure machine 13.

In the laser exposure machine 13, for example, the exposure beam Bm emitted from the semiconductor laser is applied to the photoconductors 11 of the image forming units 1Y, 1M, 1C, and 1K according to the input color material gradation data. In each of the photoconductors 11 of the image forming units 1Y, 1M, 1C, and 1K, after the surface is charged by the charger 12, the surface is scanned and exposed by the laser exposure machine 13, and an electrostatic latent image is formed. The formed electrostatic latent image is developed as a toner image of each color of Y, M, C, and K by the each of the image forming units 1Y, 1M, 1C, and 1K.

The toner image formed on the photoconductors 11 of the image forming units 1Y, 1M, 1C, and 1K is transferred onto the intermediate transfer belt 15 in the primary transfer unit 10 in which each photoconductor 11 and the intermediate transfer belt 15 come into contact with each other. More specifically, in the primary transfer unit 10, the primary transfer roll 16 applies a voltage (primary transfer bias) opposite to the charging polarity (minus polarity) of the toner to the base material of the intermediate transfer belt 15, and the toner image is sequentially superposed on the surface of the intermediate transfer belt 15 to perform the primary transfer.

After the toner image is sequentially primary-transferred to the surface of the intermediate transfer belt 15, the intermediate transfer belt 15 moves and the toner image is transported to the secondary transfer unit 20. In a case where the toner image is transported to the secondary transfer unit 20, in the transporting unit, the paper feed roll 51 rotates in accordance with the timing at which the toner image is transported to the secondary transfer unit 20, and the paper K having a target size is supplied from the paper accommodating unit 50. The paper K supplied by the paper feed roll 51 is transported by the transport roll and reaches the secondary transfer unit 20 via the transport guide 53. Before reaching the secondary transfer unit 20, the paper K is temporarily stopped, and the alignment roll (not shown) rotates according to the movement timing of the intermediate transfer belt 15 on which the toner image is held. Therefore, the position of the paper K and the position of the toner image are aligned.

In the secondary transfer unit 20, the secondary transfer roll 22 is pressed against the back surface roll 25 via the intermediate transfer belt 15. In this case, the paper K transported at the same timing is sandwiched between the intermediate transfer belt 15 and the secondary transfer roll 22. At that time, in a case where a voltage (secondary transfer bias) having the same polarity as the charging polarity (minus polarity) of the toner is applied from the power feeding roll 26, a transfer electric field is formed between the secondary transfer roll 22 and the back surface roll 25. The unfixed toner image held on the intermediate transfer belt 15 is electrostatically transferred onto the paper K collectively in the secondary transfer unit 20 pressed by the secondary transfer roll 22 and the back surface roll 25.

Thereafter, the paper K on which the toner image is electrostatically transferred is transported as-is in a state of being peeled off from the intermediate transfer belt 15 by the secondary transfer roll 22, and is transported to the transport belt 55 provided on the downstream side of the secondary transfer roll 22 in the paper transport direction. The transport belt 55 transports the paper K to the fixing device 60 according to the optimum transport speed in the fixing device 60. The unfixed toner image on the paper K transported to the fixing device 60 is fixed on the paper K by being subjected to a fixing process by heat and pressure by the fixing device 60. The paper K on which the fixed image is formed is transported to an ejected paper accommodating portion (not shown) provided in the ejection unit of the image forming apparatus.

On the other hand, after the transfer to the paper K is completed, the residual toner remaining on the intermediate transfer belt 15 is transported to the cleaning unit as the intermediate transfer belt 15 rotates, and is removed from the intermediate transfer belt 15 by the cleaning back surface roll 34 and the intermediate transfer belt cleaner 35.

Although the present exemplary embodiment has been described above, the present disclosure is not limited to the above exemplary embodiments, and various modifications, changes, and improvements may be made.

EXAMPLES

Hereinafter, the present disclosure will be described in more detail with reference to examples. However, the present disclosure is not limited to the following examples.

Example 1

Formation of Base Material Layer (Seamless Belt)

N-Methyl-2-pyrrolidone (NMP) and carbon nanotubes (manufactured by Showa Denko KK) are mixed at a mass ratio of 5:95 to prepare a dispersion liquid (hereinafter, also referred to as "CNT 5% dispersion"). The obtained dispersion liquid is subjected to high-pressure dispersion treatment (condition: 5 times at 50 MPa) with a high-pressure homogenizer (HC3 manufactured by Sanmaru Kikai Kogyo Co., Ltd.).

Subsequently, 530 parts by mass of a polyamic acid solution (manufactured by Unitica: TX-HMM (polyimide varnish), solid content concentration: 18% by mass, solvent: NMP) is added to 100 parts by mass of the dispersion liquid after the high-pressure dispersion treatment to prepare a precursor liquid. The obtained precursor liquid (liquid temperature 30° C.) is agitated with a planetary mixer (ACM-SLVT manufactured by Aikosha Seisakusho Co., Ltd.) for 15 minutes while evacuating.

As described above, a coating liquid containing 5% by mass of an aggregate (that is, a specific aggregate) in which plural carbon nanotubes are entangled with each other in the solid content is obtained.

Next, the obtained coating liquid is applied onto a cylindrical mold to form a coating film, and the coating film is fired at 380° C. to form a seamless belt-shaped base material layer having a film thickness of 80 μm.

Formation of Elastic Layer

Next, a liquid silicone rubber (manufactured by Shin-Etsu Chemical Co., Ltd., X34-1053) is applied to the outer peripheral surface of the obtained base material layer and heated at 110° C. for 15 minutes to obtain an elastic layer having a film thickness of 400 μm.

Formation of Surface Layer

Next, a fluororesin tube having a film thickness of 30 μm containing PFA is formed by injection molding.

The fluororesin tube is put on the elastic layer and heated at 200° C. for 120 minutes to form a surface layer consisting of a fluororesin tube.

Through the above steps, a fixing belt is obtained.

Examples 2 to 3

A coating liquid is obtained in the same manner as in Example 1 except that the agitating time of the precursor liquid by the planetary mixer is appropriately changed in the formation of the base material layer of Example 1. A seamless belt-shaped base material layer having a film thickness of 80 μm is formed in the same manner as in Example 1 except that the coating liquid is used. Next, an elastic layer and a surface layer are formed on the base material layer in the same manner as in Example 1 to prepare a fixing belt.

Examples 4 to 7

The coating liquid is prepared in the same manner as in Example 1 except that the precursor liquid is prepared by appropriately changing the amount of the polyamic acid solution added to 100 parts by mass of the dispersion liquid after the high-pressure dispersion treatment, in the formation of the base material layer of Example 1. A seamless belt-shaped base material layer having a film thickness of 80 μm is formed in the same manner as in Example 1 except that the coating liquid is used. Next, an elastic layer and a surface layer are formed on the base material layer in the same manner as in Example 1 to prepare a fixing belt.

Example 8

520 parts by mass of a polyamic acid solution (manufactured by Unitica: TX-HMM (polyimide varnish), solid content concentration: 18% by mass, solvent: NMP) is added to 100 parts by mass of the dispersion liquid, using a dispersion liquid after the high-pressure dispersion treatment obtained in Example 1 to prepare a precursor liquid. The obtained precursor liquid (liquid temperature 30° C.) is agitated with a planetary mixer (ACM-5LVT manufactured by Aikosha Seisakusho Co., Ltd.) for 15 minutes while evacuating. Next, 40 parts by mass of the CNT 5% dispersion liquid prepared in Example 1 is added to the agitated precursor liquid, and then the mixture is agitated for 1 minute.

As described above, the coating liquid containing 5% by mass of aggregates (that is, specific aggregates) in which plural carbon nanotubes are entangled with each other and 2% by mass of fibrous carbons that are not entangled with each other in the solid content is obtained.

A seamless belt-shaped base material layer having a film thickness of 80 μm is formed in the same manner as in Example 1 using the obtained coating liquid. Next, an elastic layer and a surface layer are formed on the base material layer in the same manner as in Example 1 to prepare a fixing belt.

Example 9

In Example 8, a coating liquid is obtained in the same manner as in Example 8 except that the amount of the polyamic acid solution added is changed to 445 parts by mass and the amount of the CNT 5% dispersion liquid added is changed to 300 parts by mass. A seamless belt-shaped base material layer having a film thickness of 80 μm is formed in the same manner as in Example 1 except that the coating liquid is used. Next, an elastic layer and a surface layer are formed on the base material layer in the same manner as in Example 1 to prepare a fixing belt.

Example 10

In Example 8, a coating liquid is obtained in the same manner as in Example 8 except that the amount of the dispersion liquid after the high-pressure dispersion treatment is changed to 99 parts by mass, the amount of the polyamic acid solution added is changed to 528 parts by mass, and further, the amount of the CNT 5% dispersion liquid added is changed to 1 part by mass. A seamless belt-shaped base material layer having a film thickness of 80 μm is formed in the same manner as in Example 1 except that the coating liquid is used. Next, an elastic layer and a surface layer are formed on the base material layer in the same manner as in Example 1 to prepare a fixing belt.

Examples 11 to 12

NMP is appropriately added to the coating liquid obtained in Example 8 to obtain a coating liquid having a lower solid content concentration than the solid content concentration of the coating liquid of Example 8. A seamless belt-shaped base material layer having a film thickness of 80 μm is formed in the same manner as in Example 1 except that the coating liquid is used. Next, an elastic layer and a surface layer are formed on the base material layer in the same manner as in Example 1 to prepare a fixing belt.

Examples 13 to 14

Using a polyamic acid solution having a higher solid content concentration than the solid content concentration (18% by mass) of the polyamic acid solution of Example 8, a coating liquid having a higher solid content concentration than the coating liquid of Example 8 is obtained. A seamless belt-shaped base material layer having a film thickness of 80 μm is formed in the same manner as in Example 1 except that the coating liquid is used. Next, an elastic layer and a surface layer are formed on the base material layer in the same manner as in Example 1 to prepare a fixing belt.

Example 15

A coating liquid is obtained in the same manner as in Example 8 except that the agitating time of the precursor liquid by the planetary mixer is changed in the formation of the base material layer of Example 8. A seamless belt-shaped base material layer having a film thickness of 80 μm is formed in the same manner as in Example 1 except that the coating liquid is used. Next, an elastic layer and a surface layer are formed on the base material layer in the same manner as in Example 1 to prepare a fixing belt.

Comparative Example 1

Using the dispersion liquid after the high-pressure dispersion treatment obtained in Example 1, 400 parts by mass of a polyamic acid solution (manufactured by Unitica: TX-HMM (polyimide varnish)) is added to 400 parts by mass of the dispersion liquid to prepare a precursor liquid, and the obtained precursor liquid is agitated with a planetary mixer for 1 minute to obtain a coating liquid. A seamless belt-shaped base material layer having a film thickness of 80 μm is formed in the same manner as in Example 1 except that the coating liquid is used. Next, an elastic layer and a surface layer are formed on the base material layer in the same manner as in Example 1 to prepare a fixing belt.

Comparative Example 2

A seamless belt-shaped base material layer having a film thickness of 80 μm is formed in the same manner as in Example 1 except that the polyamic acid solution (manufactured by Unitika Ltd.: TX-HMM (polyimide varnish)) is used as-is, as the coating liquid. Next, an elastic layer and a surface layer are formed on the base material layer in the same manner as in Example 1 to prepare a fixing belt.

Comparative Example 3

530 parts by mass of a polyamic acid solution (manufactured by Unitica: TX-HMM (polyimide varnish), solid content concentration: 18% by mass, solvent: NMP) is added to 100 parts by mass of the dispersion liquid after the high-pressure dispersion treatment, using a dispersion liquid after the high-pressure dispersion treatment obtained in Example 1 to prepare a precursor liquid. The obtained precursor liquid (liquid temperature 30° C.) is agitated with a planetary mixer (ACM-SLVT manufactured by Aikosha Seisakusho Co., Ltd.) for 120 minutes while evacuating.

As described above, a coating liquid containing 5% by mass of an aggregate (that is, a specific aggregate) in which plural carbon nanotubes are entangled with each other is obtained.

Next, the obtained coating liquid is applied onto a cylindrical mold to form a coating film, and the coating film is fired at 380° C. to form a seamless belt-shaped base material layer having a film thickness of 80 μm.

Subsequently, an elastic layer and a surface layer are formed on the base material layer in the same manner as in Example 1 to prepare a fixing belt.

Measurement of Thermal Conductivity

The thermal conductivity of the base material layer obtained in each example is measured according to the method described above.

Measurement of Tensile Elongation

The tensile elongation of the base material layer obtained in each example is measured according to the method described above.

Evaluation of Bending Durability

The fixing belt obtained in each example is attached to a fixing device of an image forming apparatus (manufactured by Fuji Xerox Co., Ltd.: Versant 3100 Press).

Using the image forming apparatus, a 10% halftone image is continuously output on A4 paper. The fixing belt is removed every 20,000 output sheets, and the presence or absence of cracks or breaks in the taken-out fixing belt is visually confirmed.

The bending durability is evaluated according to the following criteria.

A: Up to 300,000 sheets, no cracks or breaks are found in the fixing belt.

B: In 200,000 or more sheets and less than 300,000 sheets, a crack or a break in the fixing belt is observed.

C: In 100,000 or more sheets and less than 200,000 sheets, a crack or a break in the fixing belt is observed.

D: In less than 100,000 sheets, a crack or a break in the fixing belt is observed.

TABLE 1

| | Film thickness of base material layer [μm] | Specific aggregate | | | Content B of fibrous carbons which are not entangled each other [% by mass] | A/(A + B) | Measurement and evaluation | | |
|---|---|---|---|---|---|---|---|---|---|
| | | Maximum diameter [μm] | Content A (% by mass) | Minor axis Y/Major axis X | | | Thermal conductivity [S/m · K] | Tensile elongation | Bending durability |
| Example 1 | 80 | 10 | 5 | 0.20 | 0 | — | 1.3 | 30 | A |
| Example 2 | 80 | 40 | 5 | 0.20 | 0 | — | 1.8 | 25 | A |
| Example 3 | 80 | 5 | 5 | 0.20 | 0 | — | 0.8 | 34 | A |
| Example 4 | 80 | 10 | 8 | 0.20 | 0 | — | 2.2 | 22 | A |
| Example 5 | 80 | 10 | 1 | 0.20 | 0 | — | 0.5 | 37 | A |
| Example 6 | 80 | 10 | 18 | 0.15 | 0 | — | 3.9 | 17 | A |
| Example 7 | 80 | 10 | 21 | 0.15 | 0 | — | 4.3 | 12 | B |
| Example 8 | 80 | 10 | 5 | 0.20 | 5 | 0.71 | 2.1 | 22 | A |
| Example 9 | 80 | 10 | 5 | 0.20 | 15 | 0.25 | 2.5 | 10 | C |
| Example 10 | 80 | 10 | 4.95 | 0.20 | 0.05 | 0.95 | 1.6 | 32 | A |
| Example 11 | 80 | 10 | 5 | 0.08 | 2 | 0.71 | 1.1 | 23 | A |
| Example 12 | 80 | 10 | 5 | 0.10 | 2 | 0.71 | 1.5 | 28 | A |
| Example 13 | 80 | 10 | 5 | 0.31 | 2 | 0.71 | 1.7 | 29 | A |
| Example 14 | 80 | 10 | 5 | 0.60 | 2 | 0.71 | 1.8 | 15 | B |
| Example 15 | 80 | 30 | 5 | 0.20 | 2 | 0.71 | 3.2 | 28 | A |
| Comparative Example 1 | 80 | — | 0 | — | 20 | — | 1.4 | 4 | D |
| Comparative Example 2 | 80 | — | 0 | — | 0 | — | 0.3 | 39 | A |
| Comparative Example 3 | 80 | 50 | 5 | 0.15 | 0 | — | 2.2 | 3 | D |

From the above results, it can be seen that the fixing belt of present examples has high thermal conductivity and excellent bending durability as compared with the fixing belt of the comparative example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A belt comprising:

a resin; and an aggregate in which a plurality of fibrous carbons are entangled with each other, wherein a maximum diameter of the aggregate is 50% or less of a belt film thickness.

2. The belt according to claim 1, further comprising:

fibrous carbons that are not entangled with each other.

3. The belt according to claim 2, wherein a content A of the aggregate and a content B of the fibrous carbons that are not entangled with each other satisfy a relationship of A≥B on a mass basis.

4. The belt according to claim 2, wherein a ratio (A/(A+B)) of a content A of the aggregate to a total amount of the content A of the aggregate and a content B of the fibrous carbons that are not entangled with each other is 0.50 or more and 0.95 or less on a mass basis.

5. The belt according to claim 3, wherein a ratio (A/(A+B)) of a content A of the aggregate to a total amount of the content A of the aggregate and a content B of the fibrous carbons that are not entangled with each other is 0.50 or more and 0.95 or less on a mass basis.

6. The belt according to claim 1, wherein a content of the aggregate is more than 1% by mass and not more than 20% by mass with respect to a total mass of the belt.

7. The belt according to claim 2, wherein a content of the aggregate is more than 1% by mass and not more than 20% by mass with respect to a total mass of the belt.

8. The belt according to claim 3, wherein a content of the aggregate is more than 1% by mass and not more than 20% by mass with respect to a total mass of the belt.

9. The belt according to claim 4, wherein a content of the aggregate is more than 1% by mass and not more than 20% by mass with respect to a total mass of the belt.

10. The belt according to claim 5, wherein a content of the aggregate is more than 1% by mass and not more than 20% by mass with respect to a total mass of the belt.

11. The belt according to claim 1, wherein the aggregate has a ratio (minor axis Y/major axis X) of a minor axis Y to a major axis X of 1/10 or more and 1/1 or less.

12. The belt according to claim 2, wherein the aggregate has a ratio (minor axis Y/major axis X) of a minor axis Y to a major axis X of 1/10 or more and 1/1 or less.

13. The belt according to claim 3, wherein the aggregate has a ratio (minor axis Y/major axis X) of a minor axis Y to a major axis X of 1/10 or more and 1/1 or less.

14. The belt according to claim 4, wherein the aggregate has a ratio (minor axis Y/major axis X) of a minor axis Y to a major axis X of 1/10 or more and 1/1 or less.

15. The belt according to claim 1, wherein the aggregate has a ratio (minor axis Y/major axis X) of a minor axis Y to a major axis X of 1/10 or more and 1/3 or less.

16. The belt according to claim 1, wherein the fibrous carbons are carbon nanotubes.

17. A fixing belt comprising:

the belt according to claim 1; and at least one of an elastic layer or a surface layer provided on the belt.

18. A fixing device comprising:

a first rotating body; and a second rotating body arranged in contact with an outer surface of the first rotating body, wherein at least one of the first rotating body or the second rotating body is the fixing belt according to claim 17, and a toner image is fixed by inserting a recording medium having the toner image formed on a surface into a contact portion between the first rotating body and the second rotating body.

19. An image forming apparatus comprising:

an image holder;

a charging unit that charges a surface of the image holder;

an electrostatic latent image forming unit that forms an electrostatic latent image on the charged surface of the image holder;

a developing unit that develops the electrostatic latent image formed on the surface of the image holder by a developer containing a toner to form a toner image;

a transfer unit that transfers the toner image to a surface of a recording medium; and a fixing unit that fixes the toner image to the recording medium and is configured of the fixing device according to claim 18.

20. The belt according to claim 1, wherein the maximum diameter of the aggregate is 1% or more and 50% or less of the belt film thickness.

* * * * *